US007512363B2

(12) United States Patent
Kamimura

(10) Patent No.: US 7,512,363 B2
(45) Date of Patent: Mar. 31, 2009

(54) PROVIDING ELECTRICAL POTENTIAL TO A ROTATABLE DEVELOPER CARRIER IN AN IMAGE FORMING APPARATUS

(75) Inventor: Naoya Kamimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 72 days.

(21) Appl. No.: 11/530,090

(22) Filed: Sep. 8, 2006

(65) Prior Publication Data

US 2007/0071483 A1 Mar. 29, 2007

(30) Foreign Application Priority Data

Sep. 26, 2005 (JP) ..... 2005-277471

(51) Int. Cl.
*G03G 15/00* (2006.01)
*G03G 21/18* (2006.01)

(52) U.S. Cl. ..... 399/119; 399/125; 399/113; 399/90; 399/114

(58) Field of Classification Search ..... 399/111, 399/125, 113, 119, 90, 114
See application file for complete search history.

(56) References Cited

U.S. PATENT DOCUMENTS 5,642,187 A * 6/1997 Nomura et al. ..... 399/111
5,749,027 A * 5/1998 Ikemoto et al. ..... 399/113
6,055,394 A * 4/2000 Suda et al. ..... 399/107
6,101,350 A 8/2000 Suzuki et al.
6,546,217 B2 * 4/2003 Okabe et al. ..... 399/113
7,386,253 B2 6/2008 Ishii et al.
2005/0053394 A1 3/2005 Ishii et al.
2005/0201772 A1 9/2005 Ishii et al.

FOREIGN PATENT DOCUMENTS

JP 2000250310 9/2000
JP 2005049524 2/2005
JP 2005258344 9/2005

* cited by examiner

*Primary Examiner*—David M Gray
*Assistant Examiner*—G. M. Hyder
(74) *Attorney, Agent, or Firm*—Banner & Witcoff, Ltd

(57) ABSTRACT

Developing cartridges for use in image forming apparatuses having an image carrier, include: (a) a case; (b) a developer carrier supported by the case (for holding developer thereon); and (c) a conductive member engaged with or provided on the case and being electrically connected to the developer carrier. The case may be configured to allow the developer carrier to be pressed against the image carrier at a designated pressing position in a pressing direction, and the conductive member may be configured to be supplied with electrical potential while being pressed by an electrical connection member in a direction parallel to the pressing direction. Alternatively, in some structures, the conductive member may be configured to be supplied with electrical potential while being pressed by an electrical connection member in a direction parallel to a line extending from the designated pressing position to a developer carrier and image carrier contacting position.

8 Claims, 10 Drawing Sheets

PROVIDING ELECTRICAL POTENTIAL TO A ROTATABLE DEVELOPER CARRIER IN AN IMAGE FORMING APPARATUS

CROSS REFERENCE TO RELATED APPLICATION

This application claims priority from Japanese Patent Application No. 2005-277471, filed on Sep. 26, 2005, the entire subject matter of which is incorporated herein by reference.

FIELD

Aspects of the invention relate to developing cartridges, process cartridges, and image forming apparatuses, e.g., using such developing cartridges and/or process cartridges.

BACKGROUND

A photosensitive member cartridge, which is configured to set with a developing cartridge, is provided with an urging device for pressing a developing roller of the developing cartridge to a photosensitive member of the photosensitive member cartridge, via the developing cartridge, as disclosed in, for example, Japanese Laid-Open Patent Publication No. 2000-250310 or its counterpart U.S. Pat. No. 6,101,350. When the developing cartridge set with the photosensitive member cartridge is installed in an image forming apparatus, the developing cartridge is pressed by the urging device, so that the developing roller may be pressed against the photosensitive member, via the developing cartridge.

Developing bias needs to be applied to the developing roller of the developing cartridge. As disclosed in, for example, Japanese Laid-Open Patent Publication No. 2005-258344 or its counterpart U.S. Patent Application Publication No. 2005/0201772, a conductive bearing member that rotatably supports a developing roller shaft, is provided in the developing cartridge. A power supply terminal provided in an image forming apparatus contacts a lower rear end of the bearing member.

As disclosed in Japanese Laid-Open Patent Publication No. 2005-258344 or its counterpart U.S. Patent Application Publication No. 2005/0201772, when the power supply terminal provided in the image forming apparatus contacts the lower rear end of the conductive bearing member, the developing roller may be unstably pressed against the photosensitive drum, leading to deterioration of the formed image quality.

SUMMARY

According to aspects of the invention, developing cartridges, process cartridges, and image forming apparatuses are provided in which a developing roller can be stably pressed against a photosensitive member, to form quality images, utilizing a conductive member configured to electrically connect to a developing roller shaft that is pressed by an electrical connection member for applying developing bias to the developing roller.

BRIEF DESCRIPTION OF THE DRAWINGS

Illustrative aspects of the invention will be described in detail with reference to the following figures wherein.

DETAILED DESCRIPTION

A laser beam printer, as an image forming apparatus, according to illustrative aspects of the invention will be described in detail with reference to the accompanying drawings. Of course, aspects of this invention may be practiced with other types of image forming apparatuses, such as copy machines, facsimile machines, other types of printers, and the like.

Figure 1:
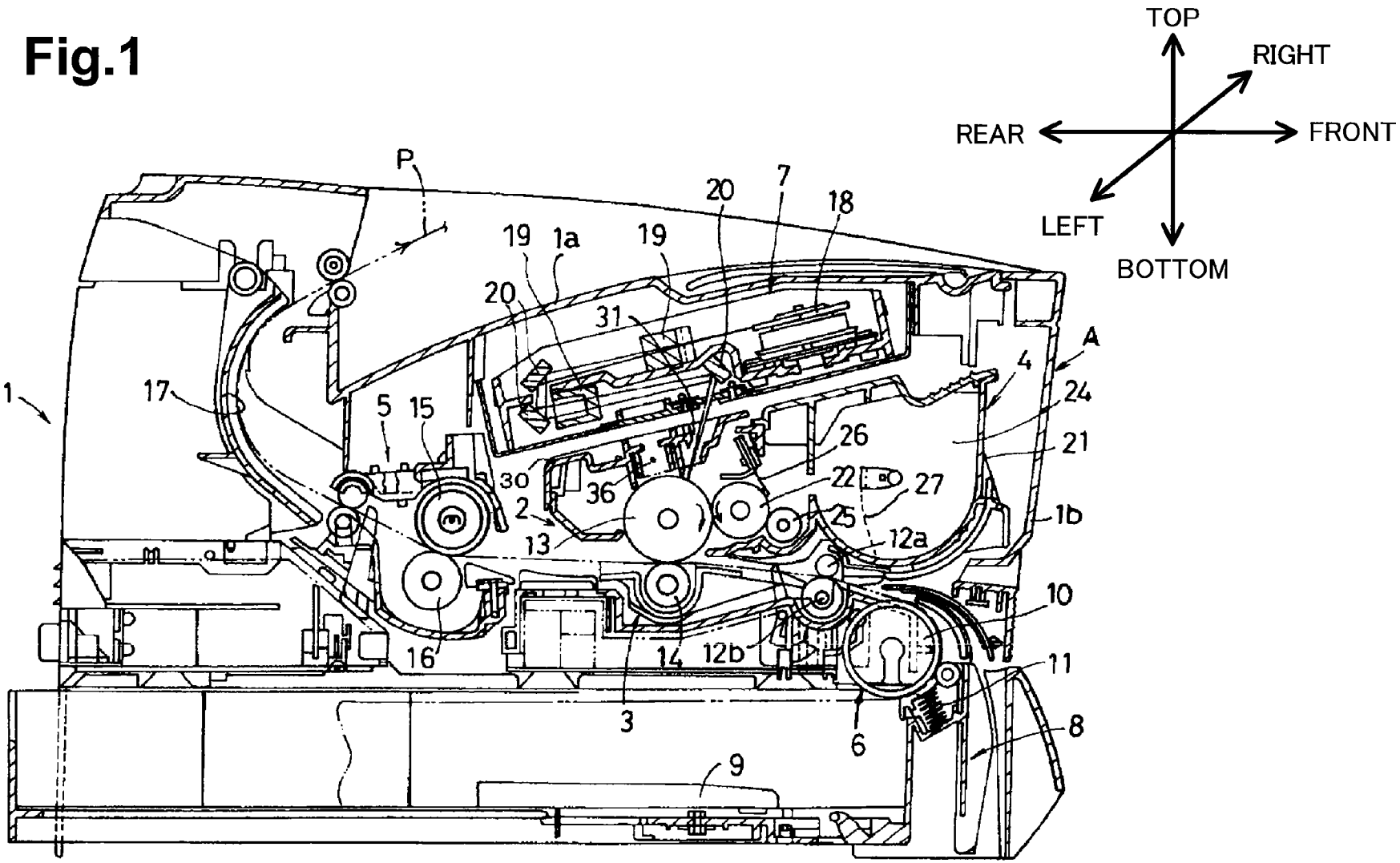
FIG. 1 is a sectional side view of a printer, as an image forming apparatus, according an aspect of the invention.

As shown in FIG. 1, a process cartridge 2 having a photosensitive member cartridge 3 and a developing cartridge 4 is removably disposed in a substantially central portion of a body housing 1 of the printer. As shown in a left portion of FIG. 1, a fixer 5 is disposed adjacent to the process cartridge 2. A sheet feeder 6 is disposed below the process cartridge 2 when the process cartridge 2 is installed in the body housing 1. A sheet cassette 8 is insertable to a lower portion of the body housing 1 from a front face of the body housing 1 (the front face being indicated by arrow A).

A laser scanning unit 7 is disposed below a discharge sheet tray 1*a* formed of synthetic resin. The discharge sheet tray 1*a* also serves as a cover.

When print data is transmitted, based on a print instruction, to the printer from an external apparatus, for example, a personal computer, a sheet P (recording medium) is separated from a stack of sheets P on a support plate 9 of the sheet cassette 8 by a separator pad 11, in a manner of one sheet at a time, as a pick-up roller 10 of the sheet feeder 6 rotates. The separated sheet P is then conveyed, via a pair of register rollers 12*a*, 12*b*, to a position between a photosensitive drum 13, as an electrostatic latent image carrier, of the process cartridge 2 and a transfer roller 14 pressed against a lower face of the photosensitive drum 13.

A laser beam is emitted from the laser scanning unit 7, which includes a laser light-emitting portion, a polygon mirror 18, a lens 19, and a plurality of reflecting mirrors 20. The laser beam travels to an upper peripheral surface portion of the photosensitive drum 13, via a light entrance portion 31 formed in a case 30 of the photosensitive member cartridge 3. The peripheral surface of the photosensitive drum 13 is thereby exposed to the laser beam in a manner corresponding to the print data, so as to form an electrostatic latent image.

Toner, as developer, supplied from a developing roller 22 of the developing cartridge 4 becomes deposited on the electrostatic latent image on the photosensitive drum 13, thereby making the image visible. After the visible toner image is transferred from the photosensitive drum 13 to the sheet P, the sheet P is conveyed between a heat roller 15 and a presser roller 16 in the fixer 5, and the sheet P is subjected to a heat-fixing process. The sheet P is then discharged onto the discharge sheet tray 1*a*, via a sheet discharge passage 17.

The process cartridge 2 includes the photosensitive member cartridge 3 having at least the photosensitive drum 13, and the developing cartridge 4 having at least the developing roller 22 that is rotatably disposed in a case 21. The developing cartridge 4 is detachably set in the photosensitive member cartridge 3. The developing cartridge 4 may be installed in the body housing 1, as the process cartridge 2, together with the photosensitive member cartridge 3 or separately from the photosensitive member cartridge 3.

The structures of the photosensitive member cartridge 3 will be described in detail with reference to FIGS. 2 and 3. In the following description, the expressions "right" and "left" of the process cartridge 2, the photosensitive member cartridge 3, and the developing cartridge 4 are used to define a side thereof in conjunction with an orientation in which the cartridges 2, 3, 4 are installed in the body housing 1.

In the photosensitive member cartridge 3, the photosensitive drum 13 is rotatably supported in a synthetic resin-made case 30, near one side thereof. A lower portion of the transfer roller 14 disposed below the photosensitive drum 13 is covered with a bottom wall 30*a* of the case 30.

Figure 2:
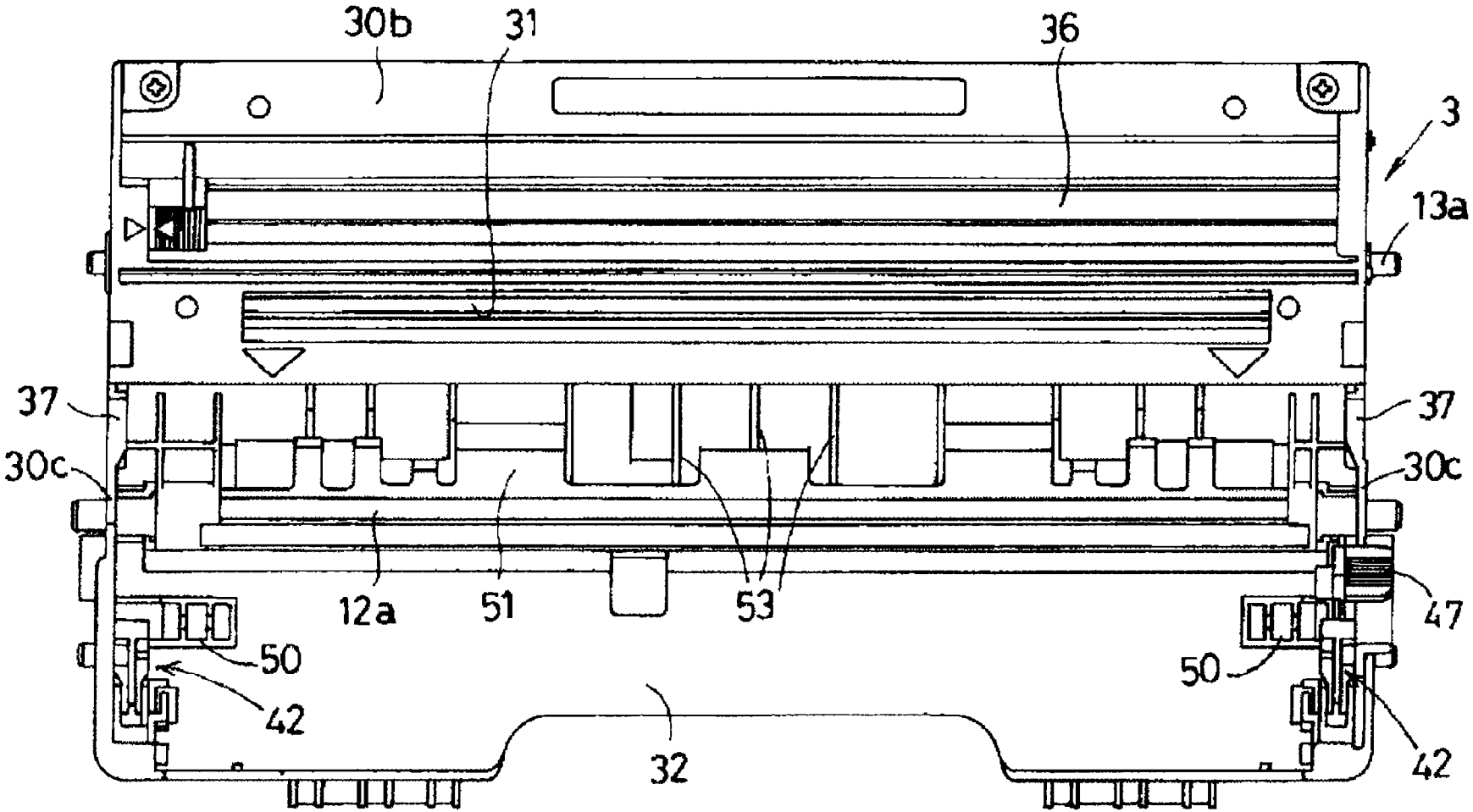
FIG. 2 is a plan view of a photosensitive member cartridge.

As shown in FIG. 2, an upper wall 30*b* of the case 30 of the photosensitive member cartridge 3 covers an upper portion of the photosensitive drum 13. As shown in FIGS. 1 and 2, the light entrance portion 31, allowing irradiation of an upper surface of the photosensitive drum 13 with the laser beam emitted from the laser scanning unit 7, is formed in the upper wall 30*b*. The light entrance portion 31 is elongated in the directions of an axis of the photosensitive drum 13. Disposed adjacent to the light entrance portion 31 is, for example, a scorotron charger 36 that charges a photosensitive surface of the photosensitive drum 13 that is formed from an organic photosensitive material or the like.

An electrostatic latent image is formed on the surface of the photosensitive drum 13 by scanning the laser beam over the surface of the drum 13 uniformly charged by the charger 36. After the electrostatic latent image is made visible (developed) by deposition thereon of a thin layer of toner supplied via the developing roller 22, the toner image is transferred to the sheet P at the transfer roller 14.

As shown in FIG. 2, a portion of the case 30 other than the upper wall 30*b* is open upward to define an accommodating portion 32 into which the developing cartridge 4 can be detachably set. An upper end face of each of right and left side walls 30*c* of the case 30 defines a guide groove 37 to guide a corresponding one of bearings 23*a*, 23*b* (see FIG. 4). The guide grooves 37 slidably support the bearings 23*a*, 23*b*, which are fitted on both end portions of the developing roller shaft 22*a* of the developing roller 22 so as to rotate relative to the shaft 22*a*. The guide grooves 37 extend toward a shaft 13*a* of the photosensitive drum 13. Therefore, when the developing cartridge 4 is set with respect to the photosensitive member cartridge 3, the developing roller 22 can be positioned adjacent to the photosensitive drum 13 so as to face the drum 13.

Figure 6:
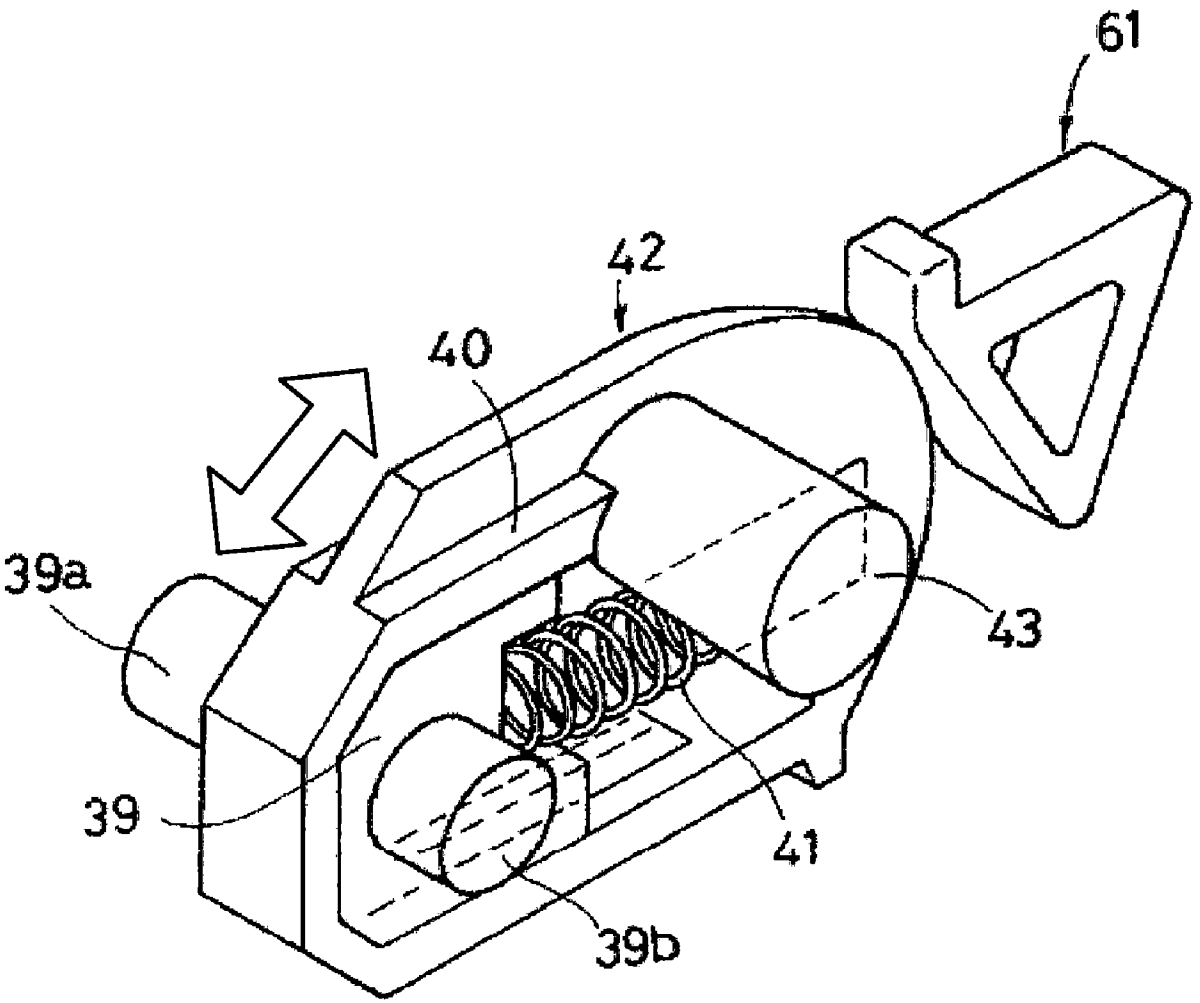
FIG. 6 is a perspective view of an urging device and an action-receiving portion.

An urging device 42 that presses the developing roller 22 against the photosensitive drum 13 via the developing cartridge 4 is pivotably and expandably mounted to an inner surface of each of the right and left side walls 30*c* of the photosensitive member cartridge 3. As shown in FIG. 6, each urging device 42 has a pivot fulcrum member 39 provided with pivots 39*a*, 39*b* protruding integrally from the right and left sides thereof, a frame-like slide support member 40 that facilitates sliding movements of the pivot fulcrum member 39 therein, and an urging spring device 41, such as a coil spring, that is disposed in the frame of the slide support member 40 so as to urge the pivot fulcrum member 39 toward one end. The slide support member 40 has a cylindrical motion acting portion 43 extending laterally. The motion acting portion 43 of each urging device 42 is disposed so that the portion 43 protrudes outward from a guide hole 44 (see FIG. 3) formed in the corresponding one of the right and left side walls 30*c*.

When the developing cartridge 4 is installed in the body housing 1 as set relative to the photosensitive member cartridge 3, an action-receiving portion 61 of the developing cartridge 4 is pressed by an end of the slide support members 40, so that the developing roller 22 can be pressed against the photosensitive drum 13, via the developing cartridge 4, with the urging device 42 and the action-receiving portion 61.

Figure 3:
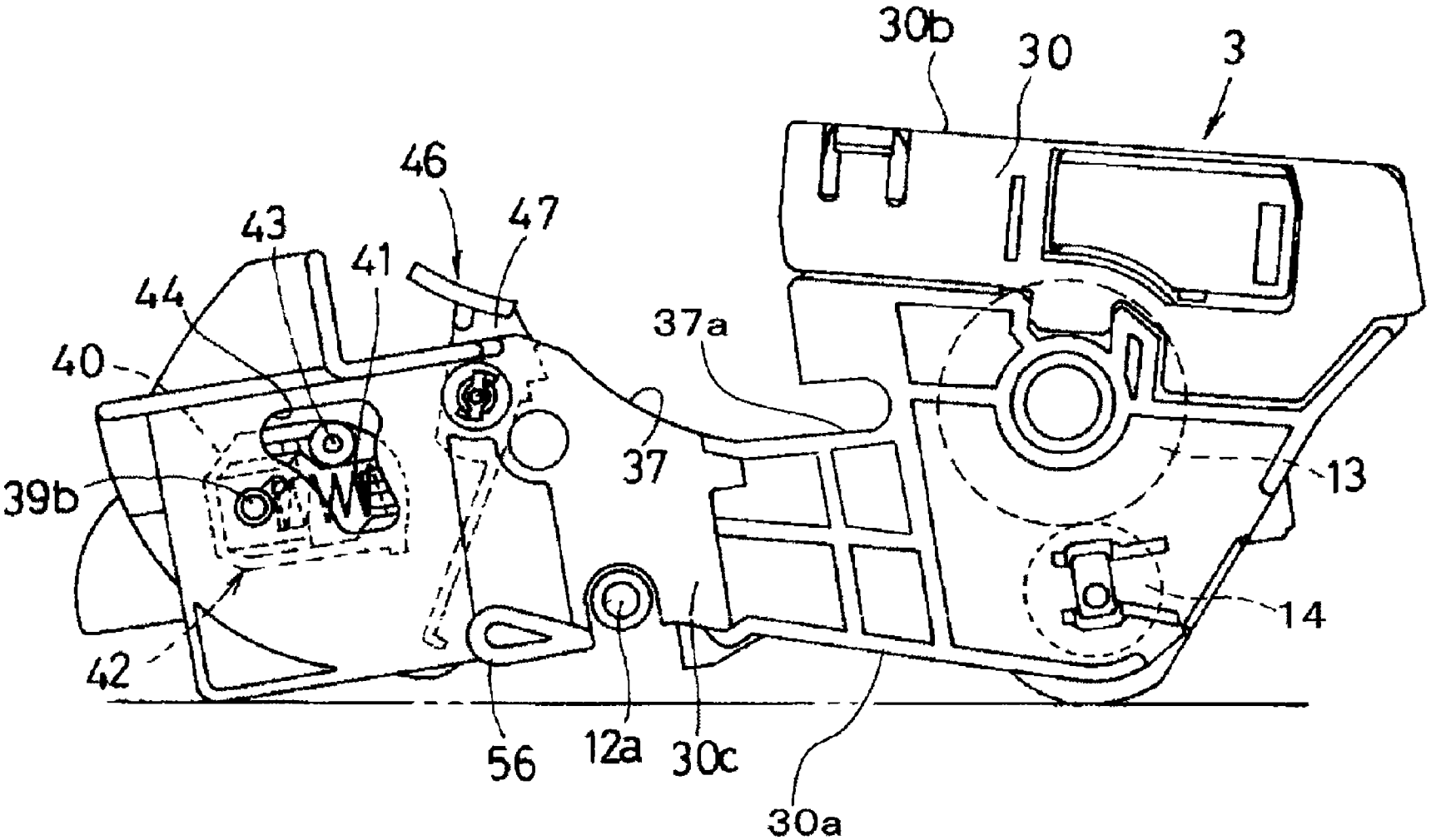
FIG. 3 is a right side view of the photosensitive member cartridge.

As shown in FIG. 3, a lock device 46 that prevents the developing cartridge 4, which is fitted into the accommodating portion 32, from moving upward out of the accommodating portion 32, is disposed at an inner side of one side wall 30*c* (the right side wall 30*c* in the illustrated example embodiment) of the photosensitive member cartridge 3. A lock lever 47 provided in the lock device 46 is pressed down to unlock the developing cartridge 4 from the photosensitive member cartridge 3.

As shown in FIG. 2, rollers 50 are disposed at a plurality of positions (two positions in the illustrated example embodiment, that is, at right and left end portions) in the bottom wall 30*a* of the case 30. The rollers 50 protrude upward from the inner surface of the bottom wall 30*a*. When the developing cartridge 4 is inserted down into the accommodating portion 32, the rollers 50 receive a portion of the weight of the developing cartridge 4, at a side across the developing roller shaft 22*a* of the developing roller 22 from the photosensitive drum 13. More specifically, the rollers 50 contact lower portions of a downward-convex curved surface of a toner containing chamber 24 (see FIG. 1) formed in the case 21 of the developing cartridge 4.

The upper roller 12*a* of the pair of register rollers 12*a*, 12*b* is mounted to the bottom wall 30*a* of the case 30 of the photosensitive member cartridge 3 in such a manner that the upper roller 12*a* is prevented from detaching. The bottom wall 30*a* has a laterally elongated introduction hole 51 adjacent to the upper roller 12*a*, to introduce the sheet P from the pair of register rollers 12*a*, 12*b* into a portion between the photosensitive drum 13 and the transfer roller 14. The upper surface of a portion of the bottom wall 30*a* near the introduction hole 51 has many ribs 53 extending in a direction from the introduction hole 51 toward a portion between the photosensitive drum 13 and the transfer roller 14. The ribs 53 are designed so that the sheet P can be smoothly conveyed with reduced contact resistance on the lower surface of the sheet P.

Guiding members 56 (only one member 56 shown in FIG. 3) protrude laterally from lower portions of the right and left sides of the photosensitive member cartridge 3. When the photosensitive member cartridge 3 is inserted into the body housing 1, the guiding members 56 fit into guide surfaces formed on inner surfaces of the right and left sides of the body housing 1.

The developing cartridge 4 will be described in detail below, with reference to FIGS. 1, 4, 5A, and 5B.

An agitator 27 that agitates toner in the toner containing chamber 24 is disposed in the case 21. The toner agitated by the agitator 27 is discharged from the chamber 24 and is carried onto the outer peripheral surface of the developing roller 22, which is rotatably disposed in the case 21, via a supply roller 25. The thickness of a toner layer on the developing roller 22 is regulated by a blade 26, as shown in FIG. 1.

Figure 5A:
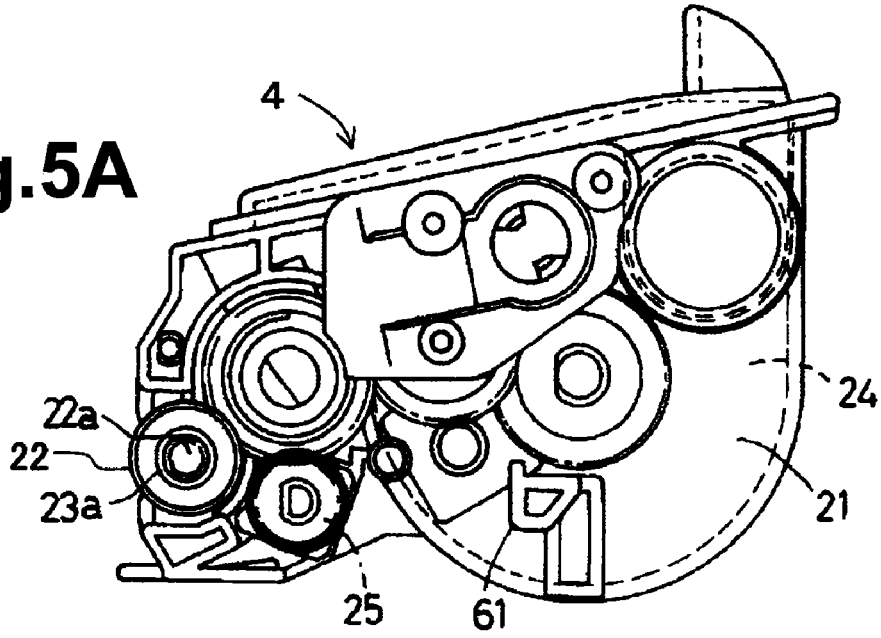
FIGS. 5A and 5B are left and right side views of the developing cartridge, respectively.
Figure 5B:
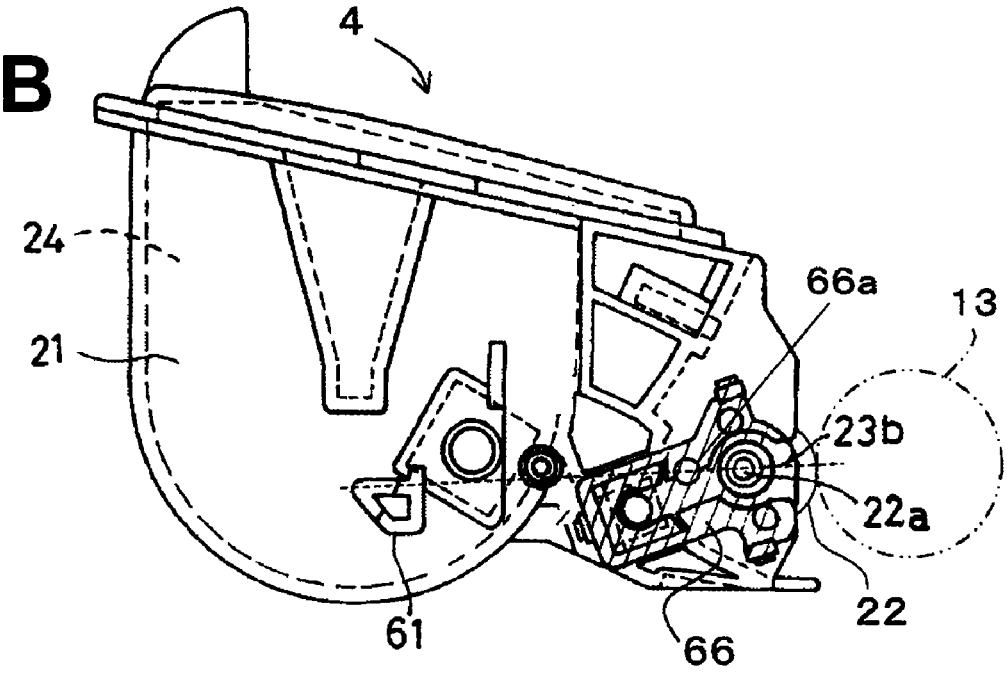

As shown in FIGS. 5A and 5B, the generally inverted triangular-shaped action-receiving portions 61 are integrally formed with the case 21 of the developing cartridge 4 so as to protrude from the right and left outer faces of the toner containing chamber 24. When the photosensitive member cartridge 3 including the developing cartridge 4 mounted thereon is installed in the body housing 1, the action-receiving portions 61 are urged by the urging devices 42 to press the developing roller 22 against the photosensitive drum 13, via the developing cartridge 4.

Figure 4:
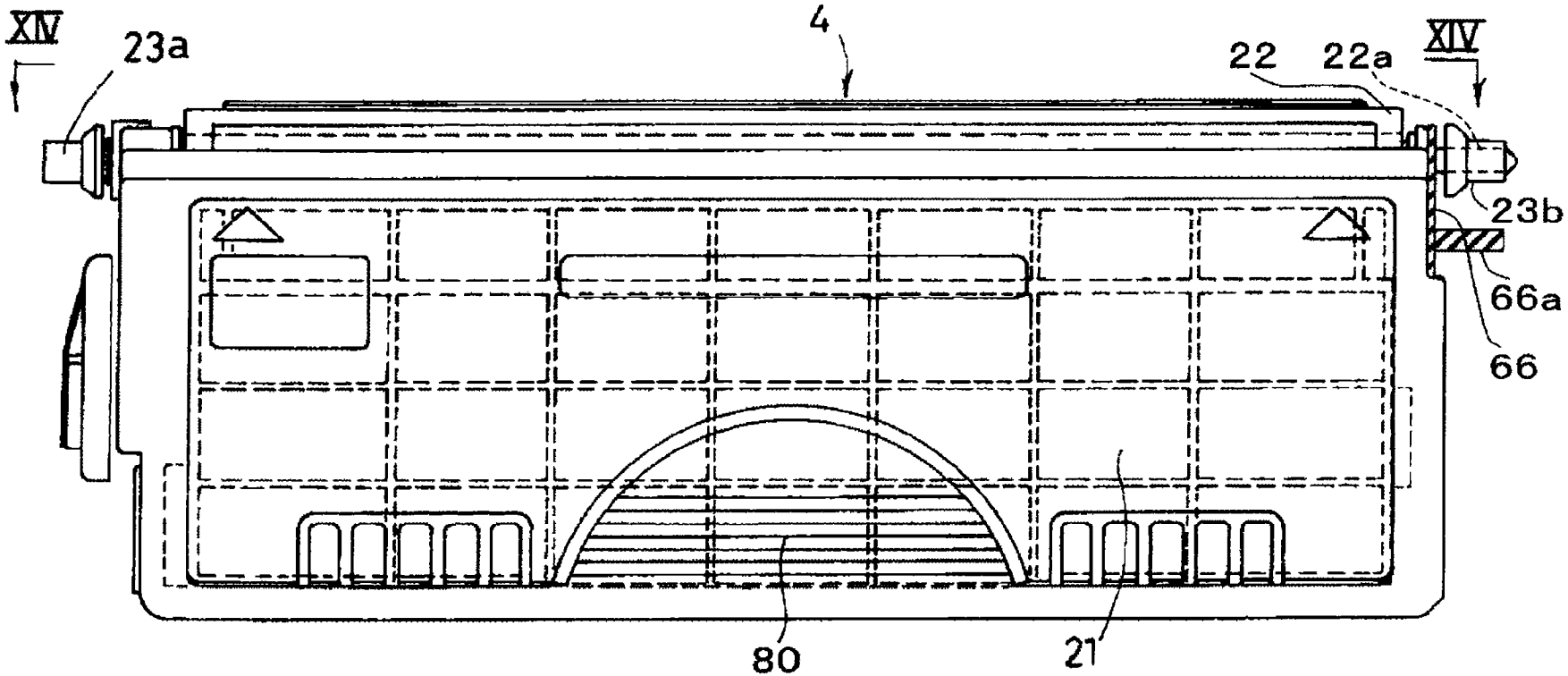
FIG. 4 is a plan view of a developing cartridge.

As shown in FIG. 4, a holding portion 80 is formed on an upper and a lower face of the case 21 of the developing cartridge 4 (only holding portion 80 formed on the upper face is shown in FIG. 4), to facilitate the handling of the developing cartridge 4.

The developing roller 22 is a rubber roller having a developing roller shaft 22*a* formed of metal, such as stainless steel, surrounded with a silicone rubber or urethane rubber dispersed with carbon black for conductivity. The surface of the developing roller 22 has a coating layer including fluorine. As shown in FIG. 4, the bearings 23*a*, 23*b* are rotatably fitted to the right and left end portions of the developing roller shaft 22*a*, so as not to be removed from the end portions of the developing roller shaft 22*a*. The bearings 23*a*, 23*b* are formed from a material having a low friction coefficient, such as an acetal resin or the like. The bearings 23*a*, 23*b* function as guided members when the developing cartridge 4 is set relative to the photosensitive member cartridge 3 along the guide grooves 37 formed on the right and left side walls 30*c*.

As shown in FIGS. 4 and 5B, a conductive member 66 configured to electrically connect to the developing roller shaft 22*a* is disposed on the developing cartridge 4. It should be noted that the conductive member 66 is hatched in FIGS. 4 and 5B for clarity. The conductive member 66 is formed of conductive resin. The conductive member 66 is mounted on a side wall (right side wall) of the case 21 of the developing cartridge 4. A projection 66*a* is integrally formed in the conductive member 66.

The operation of setting the developing cartridge 4 with respect to the photosensitive member cartridge 3 will be described. The developing cartridge 4 is inserted, with the developing roller 22 side being a leading side, into the upwardly open accommodating portion 32 provided in a front portion of the case 30 of the photosensitive member cartridge 3. During the insertion of the developing roller 22 into the accommodating portion 32, the bearings 23*a*, 23*b* disposed at the right and left side ends of the developing roller 22 slide down along the guide grooves 37 formed along the upper edges of the right and left side walls 30*c* of the case 30, so as to approach the shaft 13*a* of the photosensitive drum 13. The case 21 of the developing cartridge 4 is pivotable about the bearings 23*a*, 23*b* fitted on the developing roller shaft 2 when the bearings 23*a*, 23*b* are supported by the guide grooves 37. Therefore, when the bearings 23*a*, 23*b* come to a position on the guide grooves 37 close to the shaft 13*a* of the photosensitive drum 13 (e.g., at "U"-shaped portions of the guide grooves 37), a toner containing chamber 24 side portion of the case 21 of the developing cartridge 4 comes into the accommodating portion 32 of the photosensitive member cartridge 3 by a pivoting motion about the developing roller shaft 22*a* of the developing roller 22. Thus, the developing cartridge 4 is fittingly set in the accommodating portion 32.

While the developing cartridge 4 is set in the accommodating portion 32, the rollers 50 slidingly contact a lower surface of the case 21 on the side of the toner containing chamber 24, and the bearings 23*a*, 23*b* move along the guide grooves 37 to such a position that the developing roller 22 is located close to the photosensitive drum 13. When insertion of the developing cartridge 4 into the photosensitive member cartridge 3 is complete, the developing cartridge 4 is prevented from moving out of the photosensitive member cartridge 3 by the lock device 46.

Figure 7:
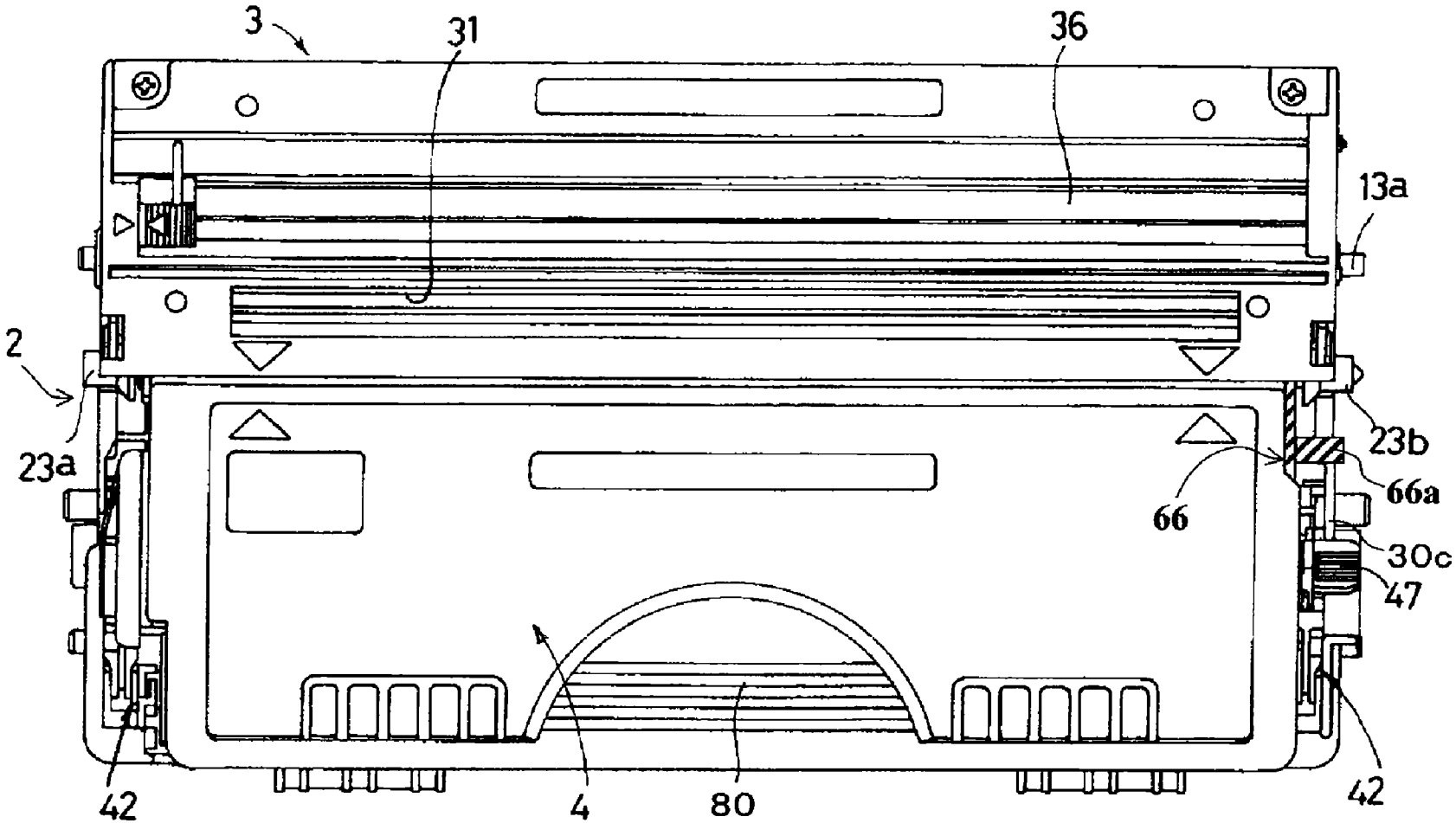
FIG. 7 is a plan view of a process cartridge.

The bearings 23*a*, 23*b* are structured so as to rotate relative to the guide grooves 37. Therefore, while the bearings 23*a*, 23*b* are moved along the guide grooves 37 during the insertion or removal of the developing cartridge 4 into or from the photosensitive member cartridge 3, the bearings 23*a*, 23*b* can smoothly slide along the guide grooves 37. The developing cartridge 4 and the photosensitive member cartridge 3 can be set into the process cartridge 2, as shown in FIG. 7.

Figure 9A:
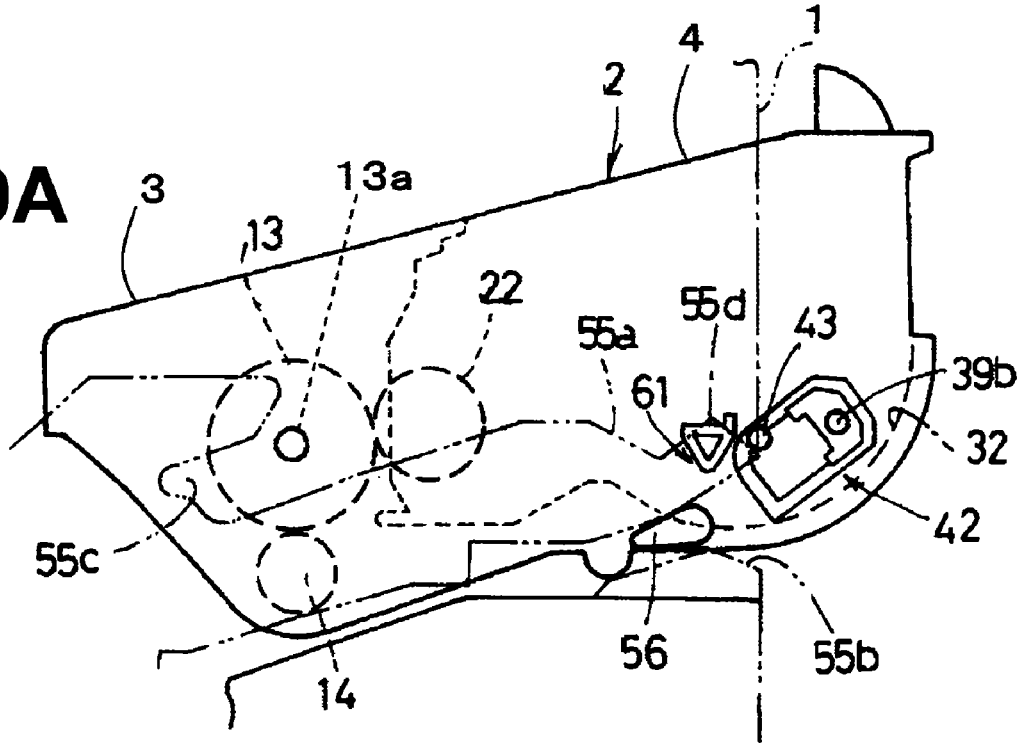
FIG. 9A is a schematic illustrating the process cartridge being inserted into the body housing.

The operation of installing the process cartridge 2 in the body housing 1 will be described below. The process cartridge 2 is designed so that the process cartridge 2 can be set into, and removed from, the body housing 1 when a lid 1*b* provided in the right-side end in FIG. 1 (a front face) of the body housing 1 is downwardly turned to form a large opening. As shown in FIG. 9A, when the process cartridge 2 is installed in the body housing 1, the motion acting portion 43 of each urging device 42 contacts the rising slope surface of upper-side guide surfaces 55*a* provided on the inner surfaces of the right and left side portions of the body housing 1, and each of the guiding members 56, protruding laterally from lower portions of the right and left sides of the process cartridge 2 (photosensitive member cartridge 3), fits into a lower-side guide surface 55*b* (only one of the guiding members 56 is shown in the drawings). Thus, the process cartridge 2 is prevented from moving upward relative to the body housing 1, and it is allowed only to be moved further inward toward the rear side of the printer along the lower-side guide surface 55*b*.

Figure 9B:
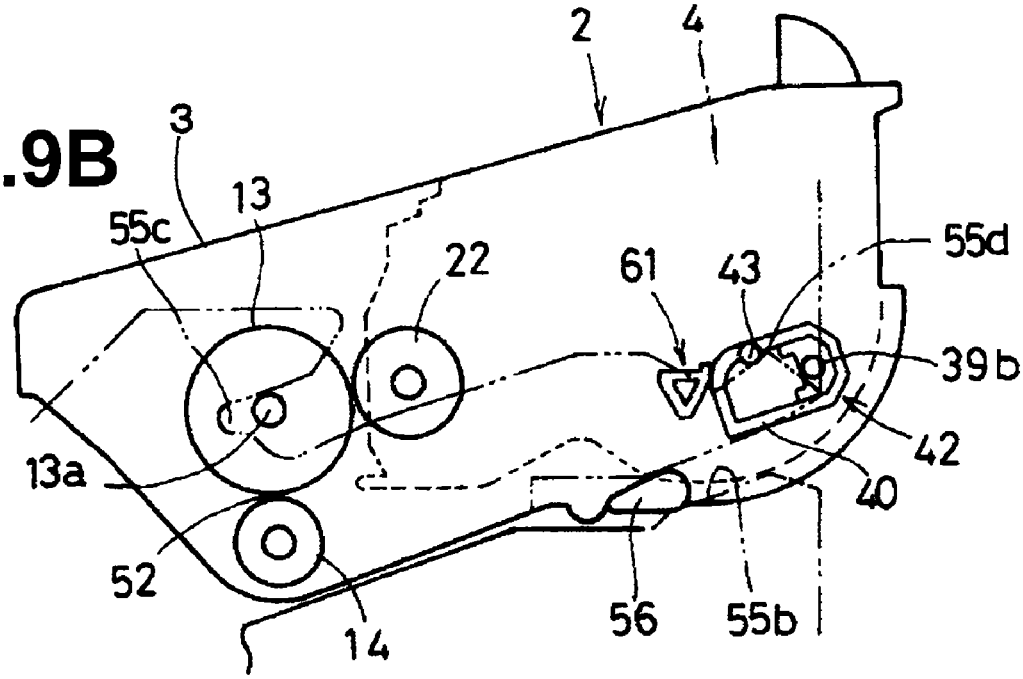
FIG. 9B is a schematic illustrating the process cartridge further being inserted into the body housing.

As the process cartridge 2 is pushed inward, the motion acting portion 43 is raised by the corresponding upper-side guide surface 55*a*, so that the slide support member 40 of each urging device 42 pivots upward about the pivots 39*a*, 39*b*. Therefore, the slide support member 40 of each urging device 42 restrains the corresponding one of the action-receiving portions 61 of the developing cartridge 4 in such a direction that a distal end portion of the slide support member 40 pushes the action-receiving portion 61. When the motion acting portion 43 of each urging device 42 comes to a summit 55*d* of the upper-side guide surface 55*a*, the slide support member 40 of each urging device 42 is pivoted to a most upward orientation. In this orientation, the distal end portion of the slide support member 40 of each urging device 42 keeps restraining the corresponding action-receiving portion 61, as shown in FIG. 9B.

As the process cartridge 2 is pushed further inward, the shaft 13*a* of the photosensitive drum 13 is set to a predetermined position in an inward end portion 55*c* of each upper-side guide surface 55*a*. At this position, an operator releases the process cartridge 2 from his/her hands, so that the developing cartridge 4 side portion of the process cartridge 2 is lowered by its own weight. This action places the upper register roller 12*a* (disposed at a lower surface side of the case 30 of the photosensitive member cartridge 3) on the lower register roller 12*b* (disposed in the body housing 1), and simultaneously, the guiding members 56 are supported at appropriate positions in the body housing 1.

When the process cartridge 2 is thus set in the body housing 1, the distal end of the slide support member 40 of each urging device 42 presses the corresponding action-receiving portion 61. Therefore, the developing roller 22 is pressed against the photosensitive drum 13 by the urging devices 42 and the action-receiving portions 61 via the developing cartridge 4.

In the above-description, the developing cartridge 4 is first set with respect to the photosensitive member cartridge 3, and the overall process cartridge 2 is installed in the body housing 1. However, the photosensitive member cartridge 3 and the developing cartridge 4 may be separately installed in the body housing 1. In this case, the guide grooves 37 for slidably supporting the bearings 23*a*, 23*b* fitted on both ends of the developing roller shaft 22*a* may be formed on the right and left sides of the body housing 1.

Figure 8:
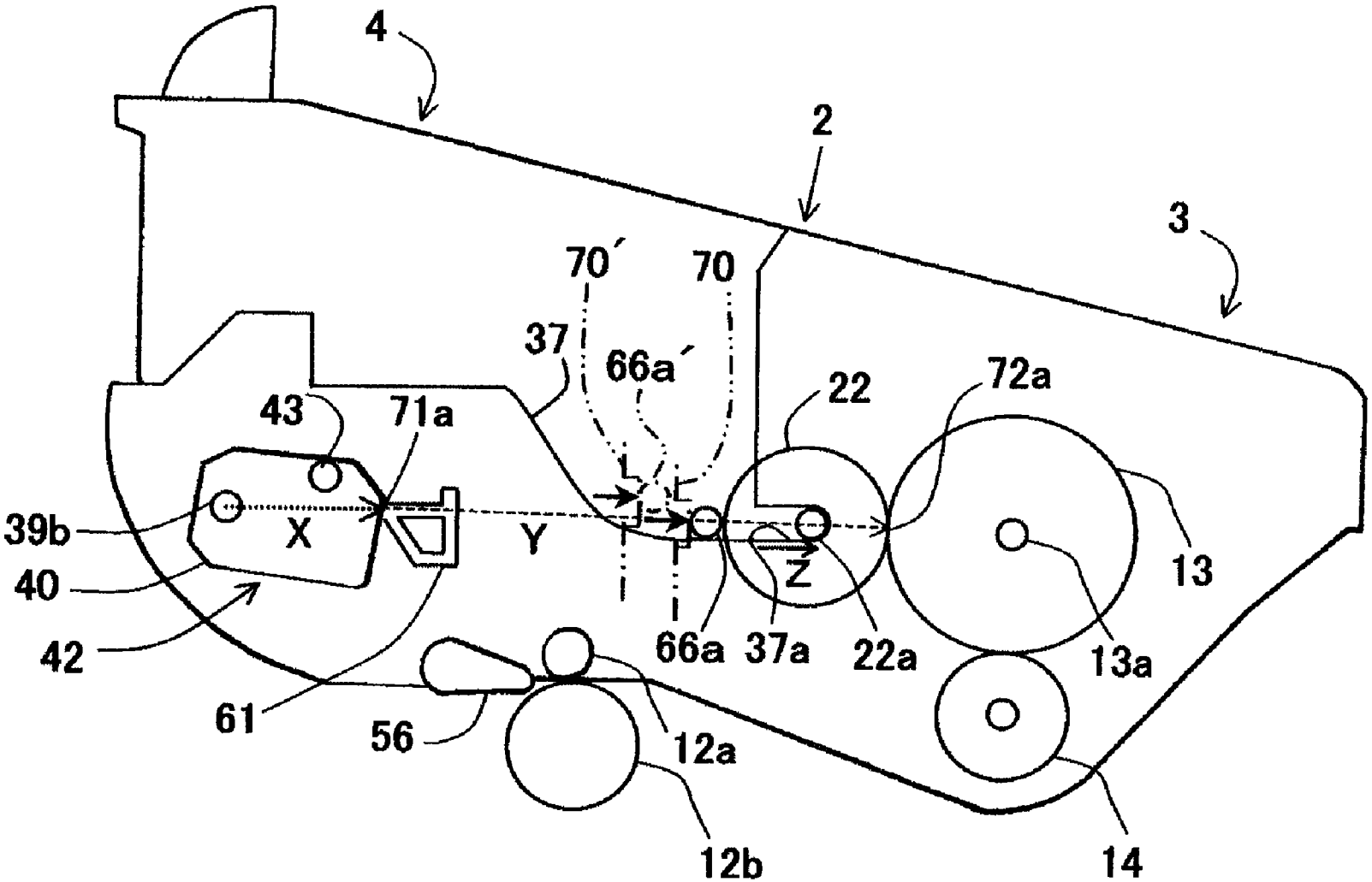
FIG. 8 is a schematic illustrating the process cartridge inserted into a body housing.

FIG. 8 illustrates the process cartridge 2, in which the developing cartridge 4 is set with respect to the photosensitive member cartridge 3, installed in the body housing 1. For clarity, unrelated portions are omitted in FIG. 8. As shown in FIG. 8, the projection 66*a* of the conductive member 66 (the conductive member 66 being configured to electrically connect to the developing roller shaft 22*a*) is pressed by electrical connection member 70 for applying developing bias to the developing roller 22.

Reference numeral 71*a* represents a developing cartridge push position at which the developing cartridge 4 is pushed as the distal end portion of the slide support member 40 of the urging device 42 pushes the action-receiving portion 61.

Line X represents a developing cartridge pushing direction to which the developing cartridge 4 is pushed by the urging device 42. More specifically, the pushing direction X is directed toward the developing cartridge push position 71*a* from the pivot 39*b*.

Reference numeral 72*a* represents a developing position where the developing roller 22 contacts the photosensitive drum 13. The developing position 72*a* is located on a line (not shown) connecting axes of the developing roller 22 and the shaft 13*a* of the photosensitive drum 13.

The projection 66*a* of the conductive member 66, which is configured to electrically connect between the developing roller shaft 22*a* and the electrical connection member 70 for applying developing bias to the developing roller 22, is disposed so as to be pushed by the electrical connection member 70 in a direction parallel to the developing cartridge pushing direction X when the developing cartridge 4 is set in the body housing 1. Therefore, the developing cartridge 4 may be stably held in the photosensitive member cartridge 3 while rattling of the developing cartridge 4 is reduced or minimized. Thus, the photosensitive drum 13 and the developing roller 22 may be prevented from unstably contacting each other and consequently, fine image quality may be maintained.

The projection 66*a* is pushed by the electrical connection member 70 in a direction parallel to a direction Y extending from the developing cartridge push position 71*a* to the developing position 72*a*. Thus, fine image quality may be reliably maintained while the photosensitive drum 13 and the developing roller 22 are prevented from unstably contacting each other.

The projection 66*a* is disposed so as to be pushed by the electrical connection member 70 on a line connecting the developing cartridge push position 71*a* to the developing position 72*a*. Therefore, the contact between the photosensitive drum 13 and the developing roller 22 may be stabilized while rattling of the developing cartridge 4 is reliably reduced or minimized. Thus, fine image quality may be reliably maintained.

The guide grooves 37 are formed on the upper edges of the right and left side walls 30*c* of the case 30 for guiding the developing roller shaft 22*a* when the developing cartridge 4 is set with respect to the photosensitive member cartridge 3. When the developing cartridge 4 installed in the body housing 1 is pressed by the urging device 42, the developing roller shaft 22*a* slides along rearmost parts 37*a* (in FIG. 3) of the guide grooves 37, and the developing roller 22 is made to contact with and press against the photosensitive drum 13. The projection 66*a* of the conductive member 66 is pressed by the electrical connection member 70 in a direction parallel to a rearmost part guiding direction Z in which the rearmost part 37*a* of the guide grooves 37 guides the developing roller shaft 22*a*. Therefore, influences of the pressing of the projection 66*a* by the electrical connection member 70 over the contact of the developing roller 22 to the photosensitive drum 13 at the developing position 72*a* may be reliably reduced. Thus, the contact between the developing roller 22 and the photosensitive drum 13 at the developing position 72*a* may be reliably stabilized while rattling of the developing cartridge 4 is reduced or minimized. Accordingly, high image quality may be maintained.

Figure 10A:
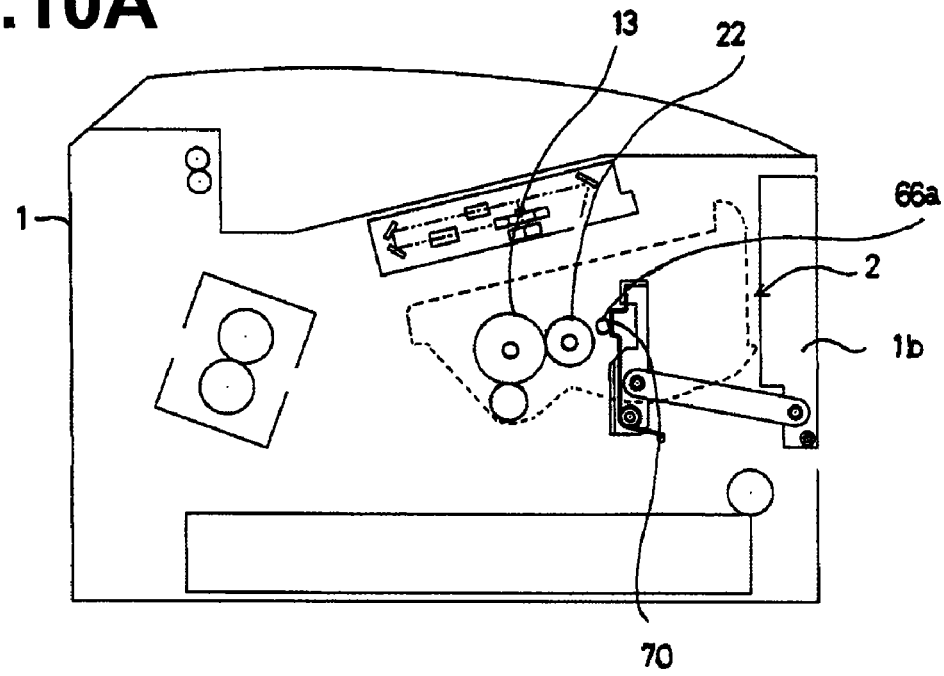
FIG. 10A is a schematic illustrating the process cartridge fully inserted into the image forming apparatus body housing and the lid closed.
Figure 10B:
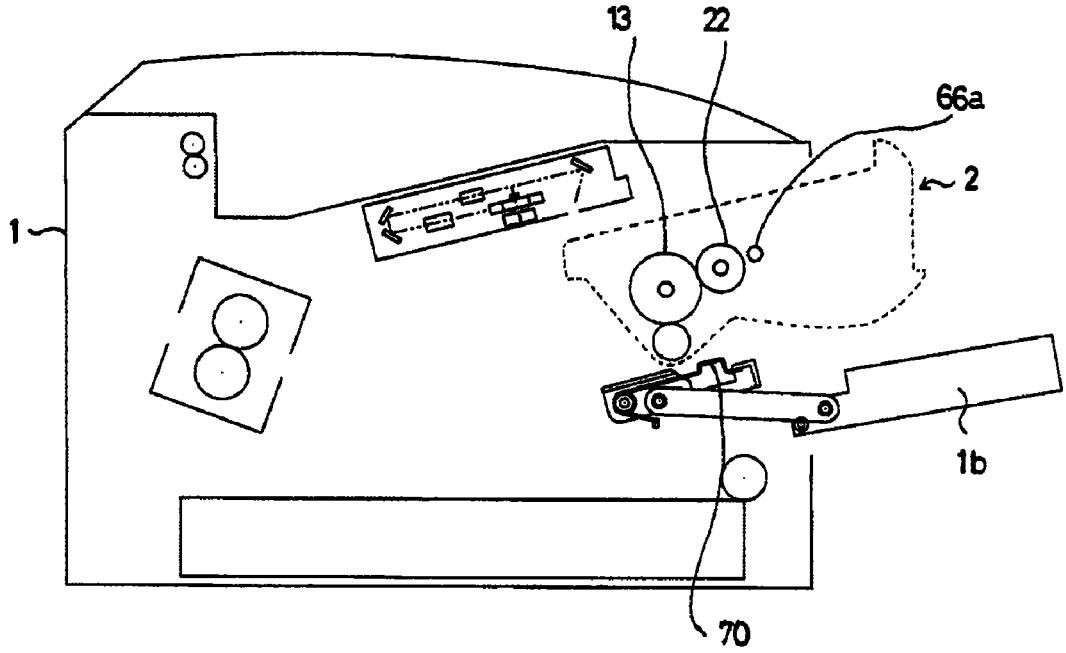
FIG. 10B is a schematic illustrating the lid open to enable removal of the process cartridge from the body housing.

The electrical connection member 70 is connected to the lid 1*b*. As shown in FIG. 10A, when the lid 1*b* is closed after the process cartridge 2 is installed in the body housing 1, the electrical connection member 70 contacts the projection 66*a* from a side opposite to the developing roller 22 and presses the projection 66*a*. As shown in FIG. 10B, when the lid 1*b* is open to remove/install the process cartridge 2 from/in the body housing 1, the electrical connection member 70 is moved to a position outside a process cartridge removal/installation area or a process cartridge removal/installation path, such that the electrical connection member 70 does not get in the way when the process cartridge 2 is removed from or installed in the body housing 1. Therefore, damage to the electrical connection member 70 and/or the projection 66*a* by colliding with each other during the installation or removal of the process cartridge 2 from the body housing 1 may be prevented. Thus, the electrical connection between the electrical connection member 70 and the projection 66*a* may be stably made.

In this example embodiment, the electrical connection member 70 is formed by bending a conductive wire to have a flat portion that presses the projection 66*a*. However, the electrical connection member 70 may be formed in any shape and/or in any desired manner as long as the electrical connection member 70 can stably press against and/or otherwise make reliable electrical connection with the projection 66*a*.

As shown in FIG. 8, it is preferable that the projection 66*a* of the conductive member 66 be pressed by the electrical connection member 70 on the line connecting the developing cartridge push position 71*a* and the developing position 72*a*. However, as shown by a projection 66*a*' and an electrical connection member 70' in FIG. 8, the projection 66*a* (66*a*') may be pressed by the electrical connection member 70 (70') at a position out of the line connecting the developing cartridge push position 71*a* and the developing position 72*a* if the projection 66*a* (66*a*') is pressed by the electrical connection member 70 (70') in a direction parallel to the developing cartridge pushing direction X by the urging device 42 and parallel to the direction Y extending from the developing cartridge push position 71*a* to the developing position 72*a*. In addition, the projection 66*a* may be pressed in a direction parallel to the developing cartridge pushing direction X or the direction Y extending from the developing cartridge push position 71*a* to the developing position 72*a*. In this case also, it is unlikely that rattling of the developing cartridge 4 will be caused by pressing the conductive member 66 by the electrical connection member 70. Thus, the contact between the developing roller 22 and the photosensitive drum 13 at the developing position 72*a* may be reliably stabilized, thereby maintaining high image quality.

In this example embodiment, the urging device 42, as a developing cartridge pushing member, is provided in the photosensitive member cartridge 3. While the motion acting portion 43 of each urging device 42 is guided by the guide surface formed on the inner surface of the right and left side portions of the body housing 1 during insertion of the photosensitive member cartridge 3 into the body housing 1, the distal end portion of the slide support member 40 pushes the action-receiving portion 61 of the developing cartridge 4. Thus, the developing roller 22 is pressed against the photosensitive drum 13, via the developing cartridge 4. However, structures for pressing the developing cartridge 4 are not limited to the above-described structures. For example, the developing cartridge 4 may be directly pressed by a developing cartridge pressing member disposed in the body housing 1 to press the developing roller 22 against the photosensitive drum 13.

Further, the electrical connection member 70 for applying the developing bias to the developing roller 22 may be provided in the body housing 1, like in this example embodiment, or a relay electrode configured to contact an electrical contact member disposed in the body housing 1 may be provided in the photosensitive member cartridge 3. In this case, the relay electrode may correspond to the electrical connection member.

While the invention has been described in connection with various example structures and illustrative aspects, it will be understood by those skilled in the art that other variations and modifications of the structures and aspects described above may be made without departing from the scope of the invention. Other structures and aspects will be apparent to those skilled in the art from a consideration of the specification or practice of the invention disclosed herein. It is intended that the specification and the described examples only are illustrative with the true scope of the invention being defined by the following claims.

What is claimed is:

1. An image forming apparatus, comprising:

an image carrier;

a developing cartridge configured to be removably installed in the image forming apparatus, the developing cartridge including:

a case, a developer carrier supported by the case, the developer carrier for holding developer thereon, and a conductive member engaged with or provided on the case, the conductive member being electrically connected to the developer carrier, wherein the case is configured to allow the developer carrier to be pressed against the image carrier at a designated pressing position in a pressing direction; and an electrical connection member engaged with the conductive member of the developing cartridge, wherein the conductive member is configured to be supplied with electrical potential while being pressed by the electrical connection member in a direction parallel to the pressing direction.

2. The image forming apparatus according to claim 1, further comprising an open-close member configured to be opened or closed for removably installing the developing cartridge in the image forming apparatus, wherein the electrical connection member is associated with the open-close member so as to move to a position to press the conductive member when the open-close member is closed, and to move to a position to retract from a path along which the developing cartridge is removably installed in the image forming apparatus when the open-close member is open.

3. The image forming apparatus according to claim 1, wherein the image carrier is mounted in an image carrier cartridge, wherein the image carrier cartridge engages the developing cartridge, and wherein the image carrier cartridge includes an urging device for pressing the developer carrier against the image carrier.

4. The image forming apparatus according to claim 3, wherein the urging device includes a spring member.

5. An image forming apparatus, comprising:

an image carrier;

a developing cartridge configured to be removably installed in the image forming apparatus, the developing cartridge including:

a case, a developer carrier supported by the case, the developer carrier for holding developer thereon, and a conductive member engaged with or provided on the case, the conductive member being electrically connected to the developer carrier, wherein the case is configured to allow the developer carrier to be pressed against the image carrier at a designated pressing position in a pressing direction; and an electrical connection member engaged with the conductive member of the developing cartridge, wherein the conductive member is configured to be supplied with electrical potential while being pressed by the electrical connection member in a direction parallel to a line extending from the designated pressing position to a contacting position where the developer carrier and the image carrier contact each other.

6. The image forming apparatus according to claim 5, further comprising an open-close member configured to be opened or closed for removably installing the developing cartridge in the image forming apparatus, wherein the electrical connection member is associated with the open-close member so as to move to a position to press the conductive member when the open-close member is closed, and to move to a position to retract from a path along which the developing cartridge is removably installed in the image forming apparatus when the open-close member is open.

7. The image forming apparatus according to claim 5, wherein the image carrier is mounted in an image carrier cartridge, wherein the image carrier cartridge engages the developing cartridge, and wherein the image carrier cartridge includes an urging device for pressing the developer carrier against the image carrier.

8. The image forming apparatus according to claim 7, wherein the urging device includes a spring member.

* * * * *